US006234530B1

(12) United States Patent
Carter

(10) Patent No.: US 6,234,530 B1
(45) Date of Patent: May 22, 2001

(54) BODY MOUNTED SAIL ASSEMBLY WITH SAFETY FEATURES

(76) Inventor: Robert L. Carter, 1227 Oakton La., Naperville, IL (US) 60540

( * ) Notice: Subject to any disclaimer, the term of this patent is extended or adjusted under 35 U.S.C. 154(b) by 0 days.

(21) Appl. No.: 09/549,305

(22) Filed: Apr. 13, 2000

Related U.S. Application Data

(63) Continuation-in-part of application No. 09/164,521, filed on Sep. 30, 1998, now Pat. No. 6,099,041.

(51) Int. Cl.[7] ..... A63C 11/00
(52) U.S. Cl. ..... 280/810
(58) Field of Search ..... 280/213, 810, 280/1.5; D12/322; 344/130; 114/102, 103

(56) References Cited

U.S. PATENT DOCUMENTS 2,018,062 * 10/1935 Hardt .
4,634,136 * 1/1987 Alexander ..... 280/213
4,669,407 * 6/1987 Cobb ..... 114/39.1
4,738,460 * 4/1988 Alexander ..... 280/213
5,071,089 * 12/1991 Fagan ..... 244/16
5,713,603 * 2/1998 Carter ..... 280/810

* cited by examiner

*Primary Examiner*—Kevin Hurley
(74) *Attorney, Agent, or Firm*—Dillis V. Allen, Esq.

(57) ABSTRACT

A human body sail assembly including a rotatable mast with upper and lower horizontal sail braces or booms that swing with the mast. The sail is tensioned by the braces and can be locked in a desired angular position by user-operated frusto-conical mating gearing coaxial with the mast. The braces can separate from the mast for safety if the user falls, and the sail can be collapsed in a compact envelope by swinging the braces toward one another adjacent the skater's back. The braces are identical and removably mounted in pivot assemblies carried by the mast so different length braces can be used with the same pivot assemblies. The pivot assemblies are defined by a large disc member carried by the mast and a brace socket with spaced circular plates indexably engaging the sides of the disc.

21 Claims, 12 Drawing Sheets

Fig. 1
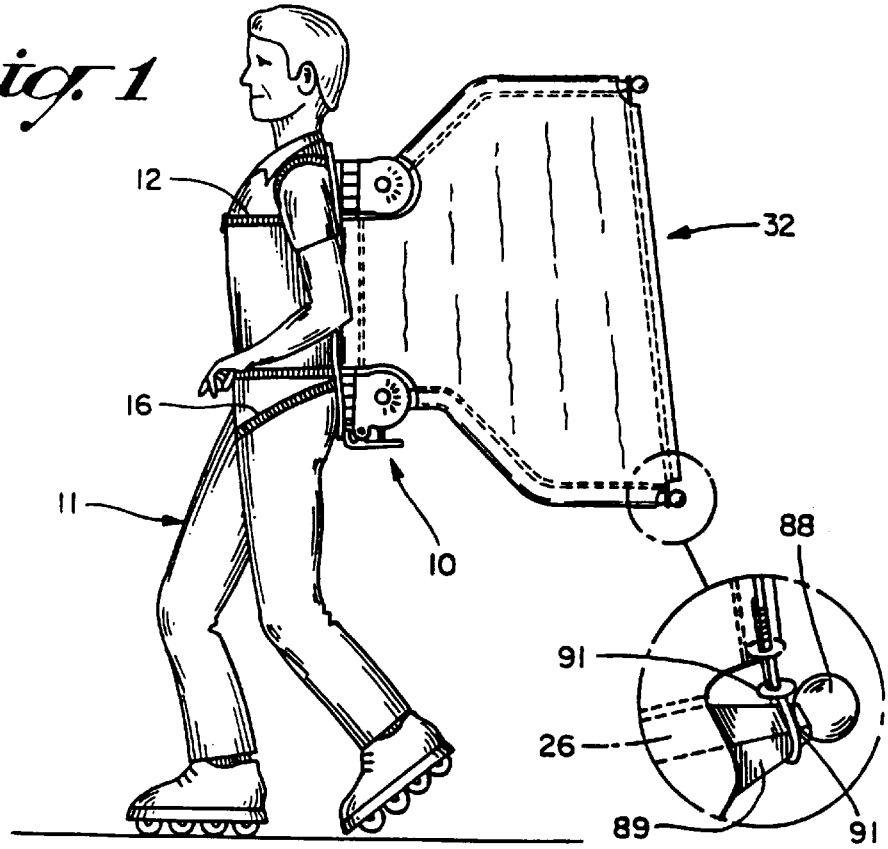
Fig. 1a
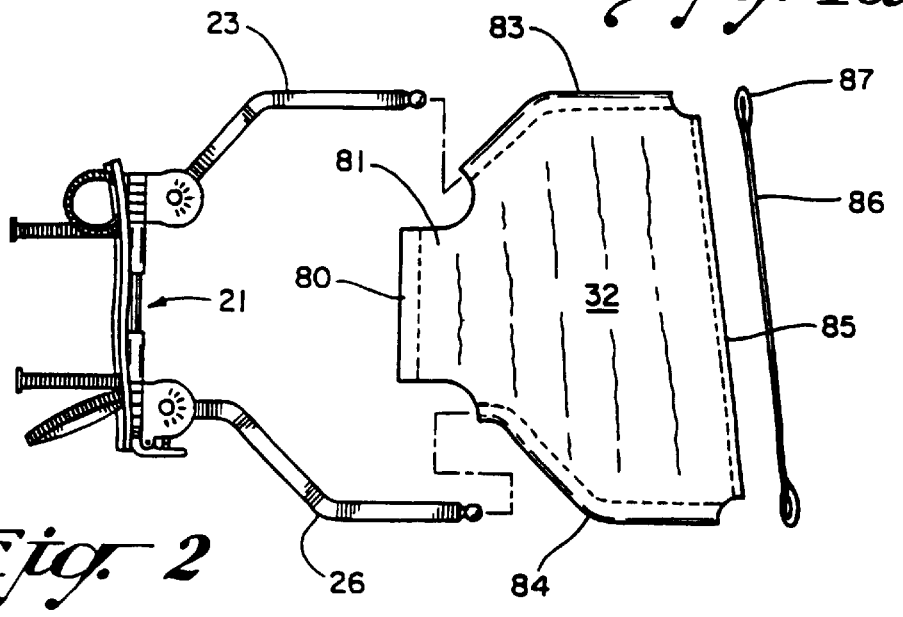
Fig. 2

BODY MOUNTED SAIL ASSEMBLY WITH SAFETY FEATURES

RELATED APPLICATION

This application is a Continuation-in-Part of my U.S. Ser. No. 09/164,521, Filed: Sep. 30, 1998, entitled "IMPROVED BODY MOUNTED SAIL ASSEMBLY" U.S. Pat. No. 6,099,041.

BACKGROUND OF THE INVENTION

While the present human body sail assembly is intended for use with in-line roller skates, it certainly has other uses, and the prior art of body sails exemplifies body sails with alternative intended applications, and these prior devices are typified in the following United States and foreign patents:

| Invention | Patent No. | Issue Date |
|---|---|---|
| | UNITED STATES PATENTS | |
| Hardt | 2,018,062 | October 22, 1935 |
| Goldberg | 3,768,823 | October 30, 1973 |
| Alexander | 4,738,460 | April 19, 1988 |
| Boyden | 5,120,070 | June 9, 1992 |
| | FOREIGN PATENTS | |
| M. Hespel | French Patent No. 1,499,954 | Sept. 25, 1967 |

The Alexander, U.S. Pat. No. 4,738,460, shows a rather complex body sail mechanism for a bicycle rider in which the angle of the back mounted sail is controlled by one of the bicyclist's hands on operating lever 32. In this mechanism it is difficult for the operator to hold the sail in any particular angular position with respect to the body.

In Alexander, the sail pivots generally vertically about the axis defined by pins 20, 22, and the arms 46 are driven by gears 44 which extend and retract the sail as the arms move from a vertical position to a horizontal position and then back again.

Alexander's system also includes a tube for reefing the mainsail, as well as a ratchet mechanism shown in FIGS. 8, 9 and 10 that lock the sail in a predetermined reefed position.

It does not have any ratchet mechanism that controls movement of the entire sail about the axis defined by pins 20, 22, which is the location of the present ratchet mechanism.

The Boyden, U.S. Pat. No. 5,120,070, also shows a ratchet-type mechanism through the mainsail illustrated in FIG. 5 of his drawings, but the ratchet mechanism does not act directly on the mast and instead operates by holding main sheet 9 in position, which of course is nothing more than a sheet commonly found on sailboats.

The Goldberg, U.S. Pat. No. 3,768,823, shows a body-held sail for use by an ice skater, but it is not physically attached to the human body and only held by the user's shoulders and hands. It is somewhat relevant in that it shows a mechanism for stretching the body sail, but stretching is effected by pulling ribs 14*a* and 16 apart rather than by tensioning the ribs with a sail embedded line in a manner similar to the stringing motion in a recurve bow.

The French Brevet D'Invention No. 1,499,954, Delivre Sep. 25, 1967, discloses a body sail for a roller skater. The sail assembly swings by hand-held arms 39 and 40, and there does not appear to be any mechanical vertical pivot axis. The sail does include what appears to be lines along its upper periphery at 48 and 49 but does not clearly exert a tensioning force on ribs 43 and 46.

The Hardt, U.S. Pat. No. 2,018,062, discloses a body sail for a skater with particular emphasis on a mechanism for extending the sail by pivoting arms 9 outwardly from a vertically downward hanging collapsed position. The patent does not appear to be particularly pertinent otherwise.

In my U.S. Pat. No. 5,713,603, issued Feb. 3, 1998, I describe and claim a human body mounted sail assembly that includes a rotatable mast with upper and lower horizontal braces that swing with the mast. The sail is held taut by these braces which are placed in tension by the sail and a bow-like string at the sail leech. The mast, braces and sail assembly can be locked in any desired angular position relative to the human back by a pawl and ratchet mechanism on the base of the mast. The sail is collapsible using push-button quick release pivots at the inner ends of both the upper and lower braces.

While my prior design operates well and in fact is similar in basic design principles to my new, improved design described herein, it is a primary object of the present invention to improve the safety of my prior sail assembly, to reduce the manufacturing costs thereof, and to provide a much simpler sail assembly that is easier to manufacture and far simpler for the user to replace parts without the need for special tools or service centers.

It is, therefore, a primary object of the present invention to ameliorate the problems noted above in a human body mounted sail assembly and to provide one that is easier for the user to assemble and operate, one which collapses into a smaller envelope, and one that has enhanced safety features.

SUMMARY OF THE PRESENT INVENTION

In accordance with the present invention, an improved human body mounted sail assembly is provided including a flexible back contoured elastomeric base strapped to the user's back. Vertically spaced plastic mast pivot brackets are fixed to the base and rotatably support the mast, which includes a telescopic assembly designed to extend and contract with flexure of the sailor's back. A pair of booms or sail braces are pivoted to the ends of the mast to permit the sail to be collapsed. These sail braces are clamshelled to the mast in a way that permits the braces to disconnect for safety when the sailor falls, impacting the braces with sufficient force. The sail can be locked in any desired angular position by user operated interengaging frusto-conical gearing on the lower base bracket and the lower sail brace that automatically releases upon sufficient collision force. The mast assembly, the braces, and other parts are molded with high glass filled plastics to enhance the high strength and bendability of these parts for safety as well as durability.

All parts in the assembly are user replaceable to eliminate the need for either service centers or "ship in" manufacturer-provided service.

The assembly can be manufactured in multiple sizes for different torso sizes with changes only in the size of the mast, base and sail.

Also according to the present invention, the sail braces are removably mounted in pivot assemblies carried by the upper and lower ends of the mast. This enables the braces to be replaced or repaired, or the manufacturer can utilize different length braces; for example, 2 feet, 2½ feet, and 3 feet, to accommodate different size sails that in effect change the entire sail assembly to have a plurality of models to satisfy different user requirements.

Also, the upper and lower braces are identical extrusions to reduce costs and are "S" shaped in configuration with the upper brace being rotated about its axis 180 degrees from the lower brace to accommodate the narrower sail luff.

A further object of the present invention is the provision of brace pivot assemblies on the mast which have a heavier duty construction than in my U.S. Ser. No. 09/164,521. Toward this end, the mast carried portion of the pivot assembly is a large disc-like member with a central spheroidal member and a plurality of radial indexing bars. A socket member, which removably carries the brace, has spaced walls that engage the opposite sides of the disc member and have 180 degrees of contact therewith to increase the structural integrity of the pivot assembly while at the same time permitting the socket member to disengage from the disc upon a sufficient impact force.

Finally, the roach of the sail is provided with a bow-like string with eyelets that are cinched to the sail braces with elastomeric rings that prevent the eyelets and bow string from falling off the braces when the sail is collapsed.

While in the exemplary embodiment, there are provided two sail assemblies; i.e., two masts and two sails, it should be understood that the principles of the present invention apply to a single sail assembly. Other objects and advantages will appear more clearly from the following detailed description.

BRIEF DESCRIPTION OF THE DRAWINGS

FIG. 1 is a side view of the human form with a present human body mounted sail assembly carried thereby;

FIG. 1*a* is an enlarged telescopic view of the interconnection between the sail bow string and the lower sail brace;

FIG. 2 is an exploded side view of the sail assembly illustrated in FIG. 1;

DETAILED DESCRIPTION OF THE PREFERRED EMBODIMENTS

Figure 12:
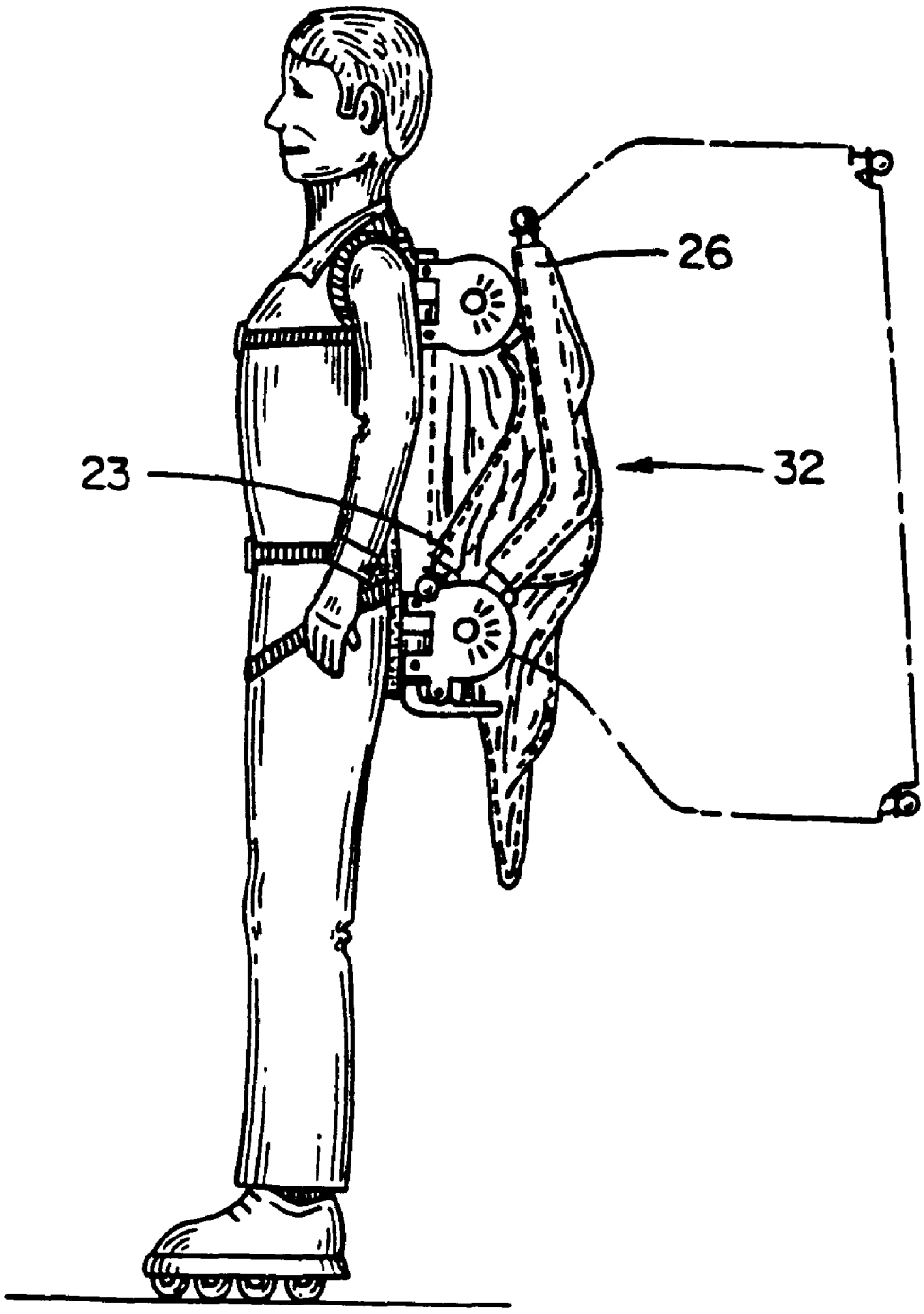
FIG. 12 is a side view of a human form with the present human body mounted sail assembly in its collapsed position.
Figure 13:
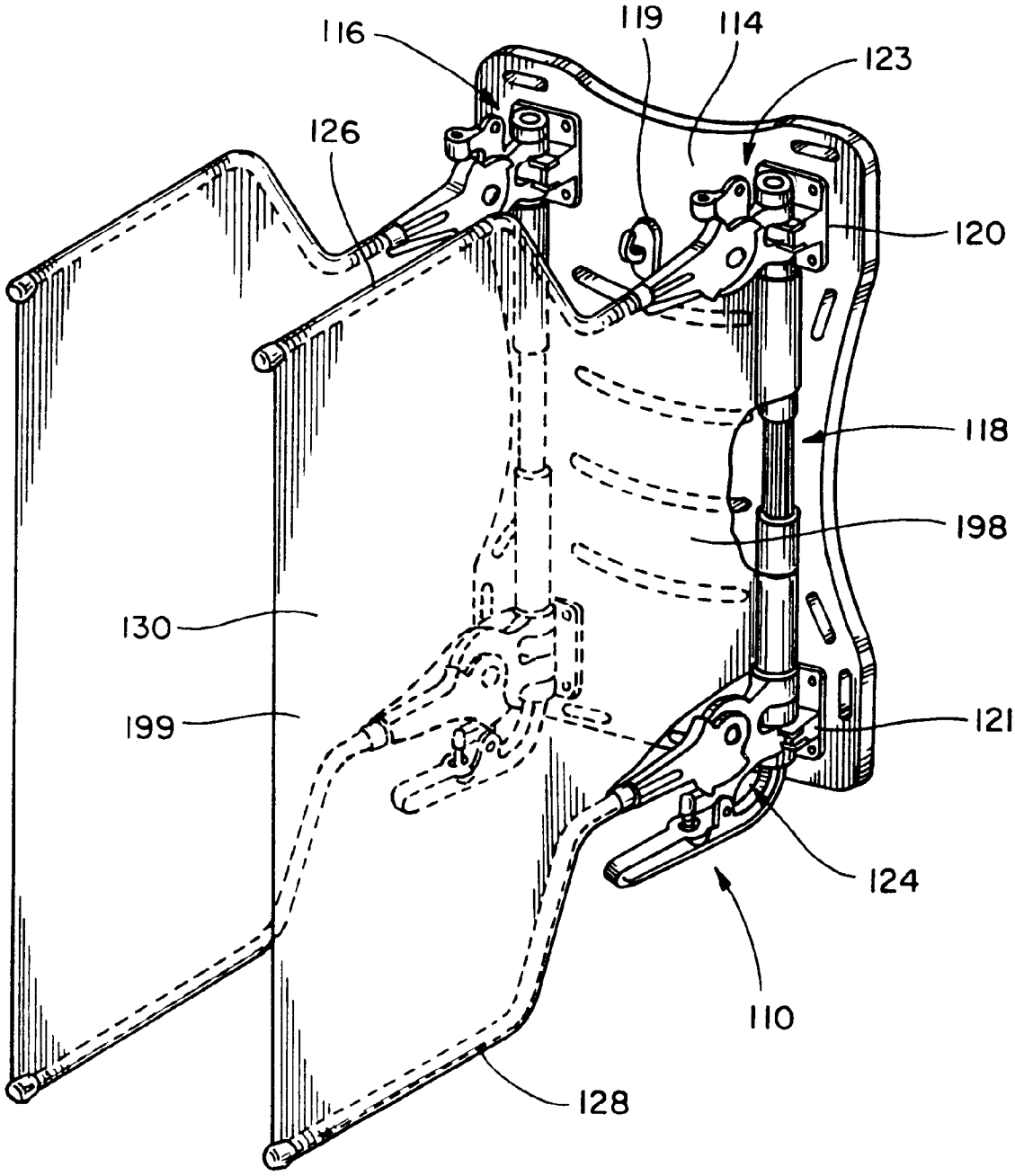
FIG. 13 is a perspective view of another embodiment of the present human body mounted sail assembly.

Referring to the drawings and particularly FIGS. 1 to 7, the present body mounted sail assembly is designated generally by the reference numeral 10, and as shown in FIGS. 1 and 12, is attached to the back of a skater 11 by an upper strap assembly 12 threaded through upper slots 13 in a base 14 and a lower strap arrangement 16 threaded through lower slots 17 in base 14.

The sail assembly 10 is seen to generally include the base 14, base mounted bracket assemblies 19 and 20, a rotatable mast assembly 21, an upper sail brace or boom 23 attached to the upper end of the mast by a clamshell pivot assembly 24 and a lower sail brace 26 pivotally connected to the lower end of the mast assembly 21 by a lower clamshell pivot assembly 28, a frusto-conical gearing assembly 30 for locking the braces 23 and 24 in a fixed vertical plane, and a sail assembly 32.

It should be understood that the above description relates to the right sail assembly illustrated in the drawings and that the left sail assembly, unnumbered, is identical to the sail assembly described herein.

Figure 3:
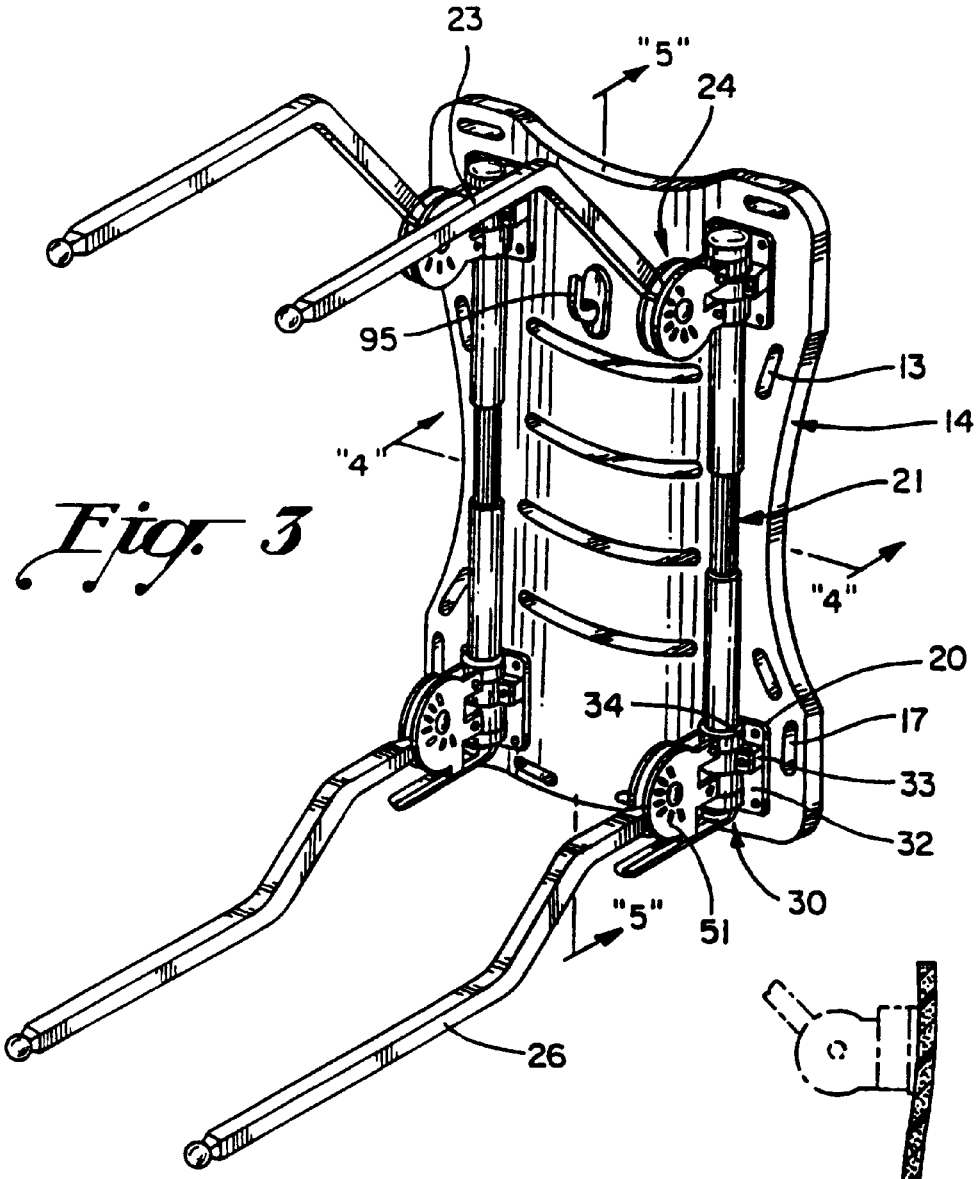
FIG. 3 is a rear perspective view of the present human body mounted sail assembly with the sails removed.
Figure 4:
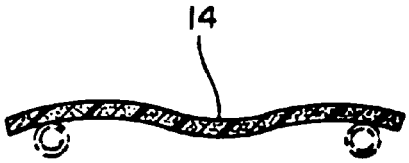
FIG. 4 is a cross section through the back mounted base taken generally along line 4—4 of FIG. 1.
Figure 5:
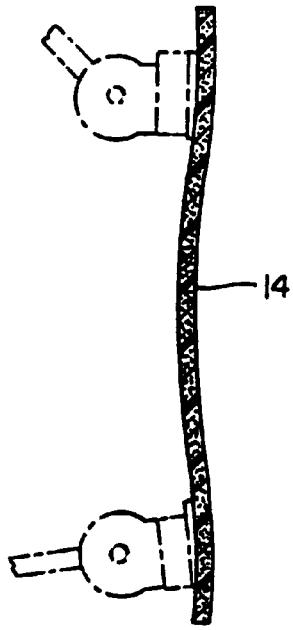
FIG. 5 is a vertical section through the back brace taken generally along line 5—5 of FIG. 3.
Figure 6:
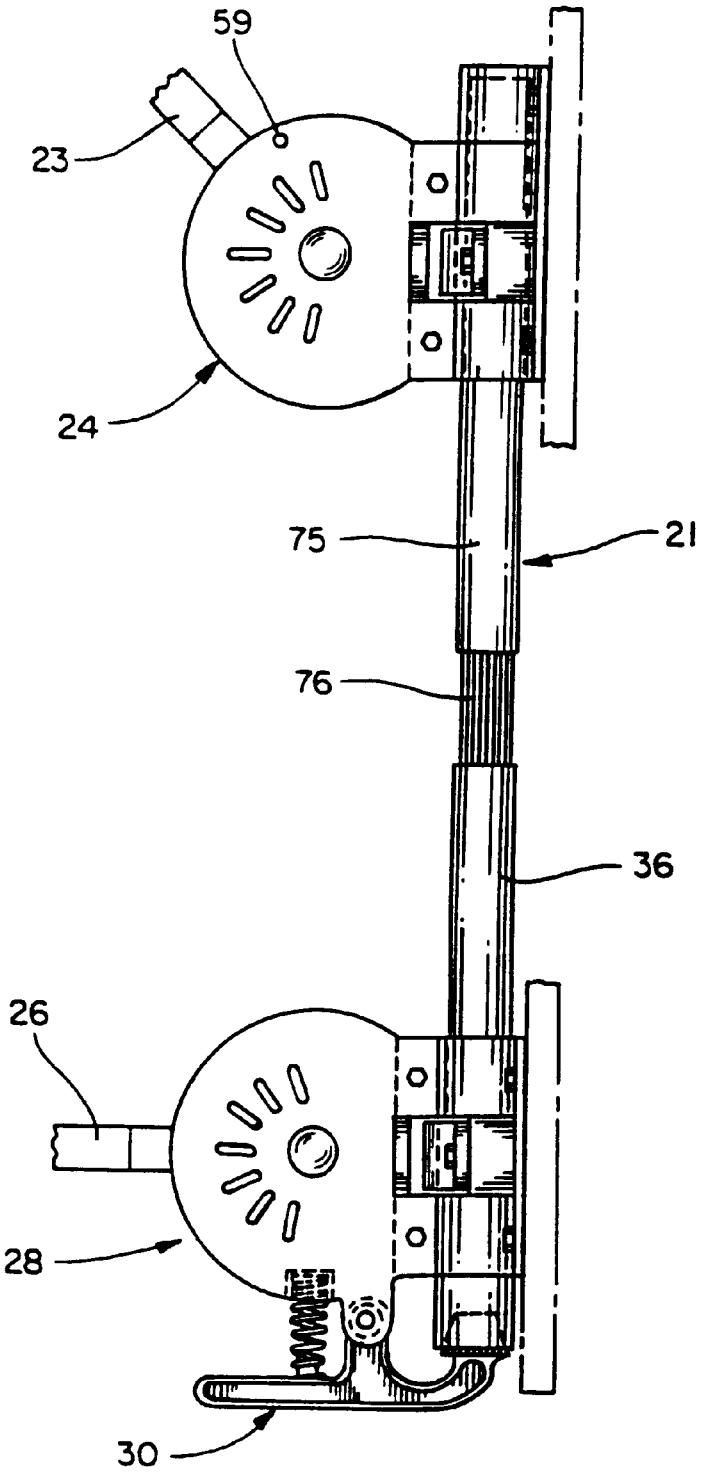
FIG. 6 is a side view, with the sail braces fragmented of the mast brackets, mast assembly, and clamshell pivot assemblies.

As seen in FIGS. 3, 4 and 5, the base 14 is a flexible molded elastomeric one-piece member that is sufficiently flexible so that it can bend and flex as the skater twists and bends his or her back.

Figure 7:
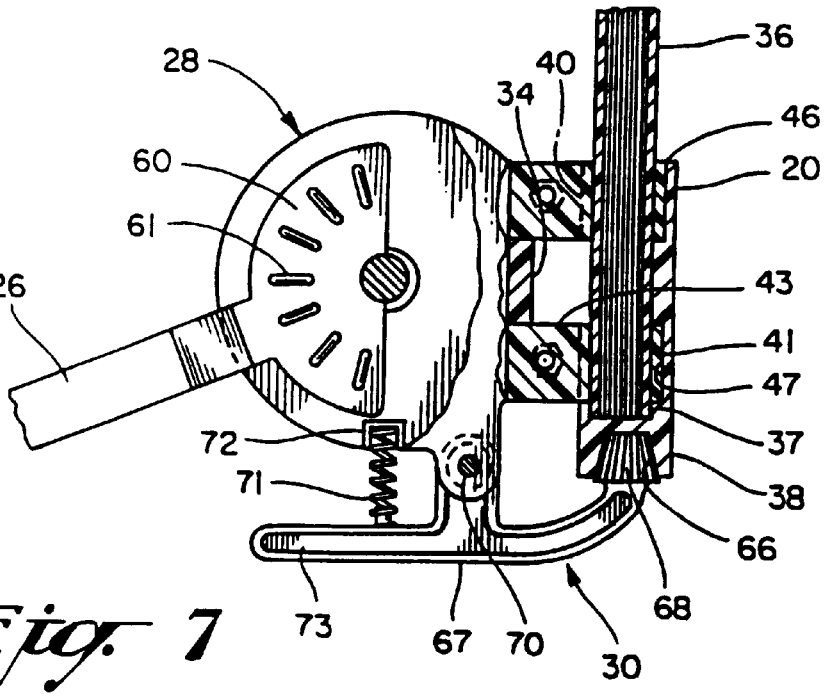
FIG. 7 is a partly fragmented view of the lower sail brace clamshell and frusto-conical gearing assembly.

The base brackets 19 and 20 are identical and as seen in FIGS. 3 and 7, include a flat back plate 32 having an integral boss 33 projecting outwardly therefrom. An arcuate bracket 34 is fixed to the boss 33 and forms a bearing for lower mast section 36. Also, the bracket 20 has a lower boss 38 with a bore 37 therein that rotatably receives the lower end of mast section 36, and the bracket 19 has an identical bore.

The lower clamshell assembly 28 includes a one-piece bracket that includes an upper sleeve 40 and a lower sleeve 41 with outwardly extending flanges 42 and 43. The annular sleeves 40 and 41 are glued to the lower mast section 36 and are rotatably mounted in semi-annular recesses 46 and 47 in the bracket 20.

Figure 9:
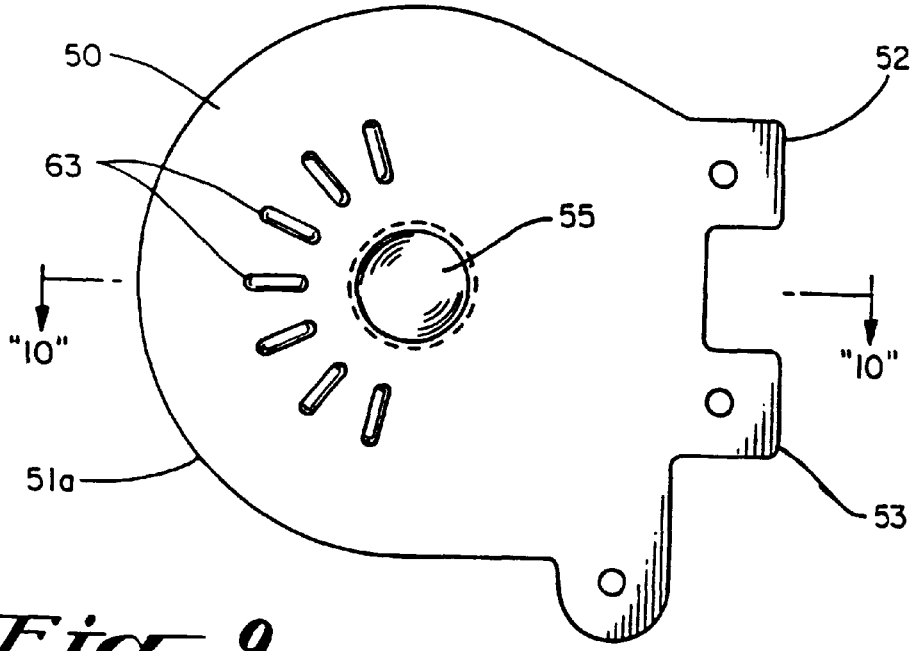
FIG. 9 is an inner side view of one of the clamshell plates illustrated in FIGS. 3 and 7.
Figure 10:
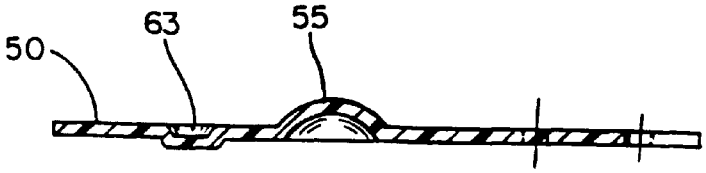
FIG. 10 is a longitudinal section through the clamshell plate taken generally along line 10—10 of FIG. 9.

The clamshell assembly 28 includes a pair of mirror image side plates 50 and 51, that as seen in FIG. 9, include a circular portion 51*a* with a pair of outwardly extending tabs 52 and 53 that are fastened to the sides of the flanges 42 and 43, as seen in FIGS. 3 and 7.

The side plates 50 have a spheroidal recess 55 that receives a ball joint 56 that has a central annular portion 57 and spheroidal ends 58 mounted in the spheroidal recesses 55. The ball joint 57 forms the pivot for the semi-annular plate portion 60 of the lower sail support 26, as seen clearly in FIGS. 11 and 12.

Figure 11:
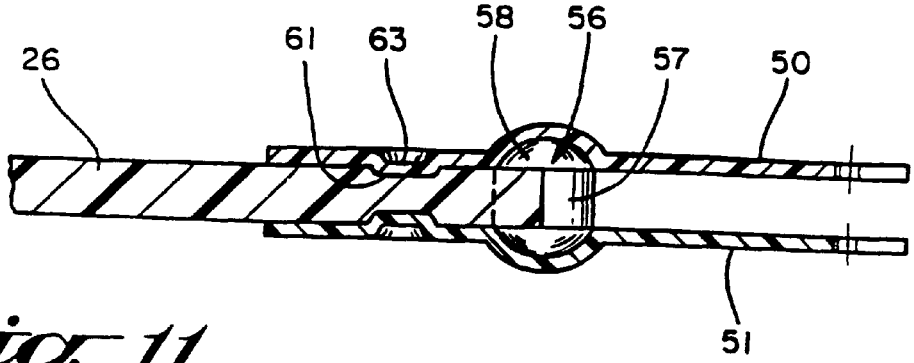
FIG. 11 is a cross section taken centrally through one of the clamshell plates showing the internal ball joint.

As seen in FIG. 11, both opposite sides of the semi-circular plate portion 60 have a plurality of radial grooves 61 integrally molded therewith that engage with complementary ribs 63 in the inside surfaces of the clamshell plates 50 and 51 to lock the sail brace 26 in its tensioned position, tensioning sail assembly 32, and also permit the sail support arms to be ratcheted to its collapsed position illustrated in FIG. 12.

Because the clamshell plates 50 and 51 are fixed together at the mast side of the plates, and because the plates 50 and 51 are constructed of plastic, they are sufficiently flexible so that upon sufficient impacting force upon the sail brace 26, the plates 50 and 51 will separate sufficiently so that the sail brace 26 can separate from the clamshell plates 50 and 51.

It should be understood, however, that because of this flexibility, after falling or impacting the sail brace with its subsequent separation, the user can easily reassemble the sail brace to the clamshell plates 50 and 51 and continue on the sailing journey.

It should also be understood that the upper clamshell assembly 24 and the mast connection are identical to that described with respect to the lower clamshell assembly 28 with the exception of the sail locking mechanism 30 so that a detailed description is unnecessary.

Also, pin 59 limits upward rotation of brace 23, so as not to allow sail 32 to block the visibility of the skater.

As seen more clearly in FIG. 7, the frusto-conical angular sail locking mechanism 30 is seen to include a frusto-conical gear 66 integrally molded in the lower end 38 of the one-piece lower bracket 20. A pivotal operating arm 67 has a complementary frusto-conical gear 68 integrally molded therewith that when engaged into the gear 66 locks the lower clamshell assembly 28 and the lower sail bracket 26 in a fixed angular position. The operator 67 is pivotally mounted to the clamshell plates 50 and 51 by a pin 70, and a spring 71 seated in a seat 72 in the plates 50 and 51 biases the operator 67 in a direction to engage the gears 66 and 68.

The operator 67 has a handle portion 73 that is in the same plane as the lower clamshell assembly and in a position to be easily operated by the skater's hand.

The teeth on the gears 66 and 68 are curved in cross section, and because of this and the fact that the gearing is frusto-conical in design, the mast as well as the sails and the clamshell assemblies, are permitted to pivot about the axis of the mast upon collision because the gearing 66 and 68 will separate upon sufficient lateral force applied to the supports 23 and 26, permitting relative rotation between gears 66 and 68.

Figure 8:
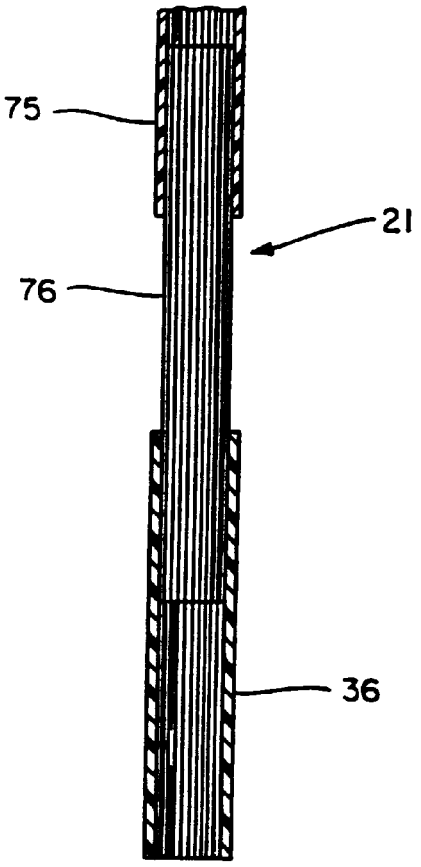
FIG. 8 is a fragmented vertical section of the central portion of the mast assembly.

As seen in FIG. 8, the mast assembly includes an upper section 75, the lower section 36, and an intermediate section 76. The upper and lower sections 75 and 36 have internal splines and the central section 76 has external splines, mating with the splines on the upper and lower section, and this design enables the mast assembly to extend and contract with flexure of the flexible base 14 as the skater twists and bends.

As seen in FIGS. 1, 1*a* and 2, sail assembly 32 has a pocket 80 at its left portion 81 that sleeves around mast assembly 21, has a top pocket 83 received on upper sail brace 23, and a foot pocket 84 received on lower brace 26.

Sail assembly 32 also has a leech pocket 85 that receives a bow-like string 86 with eyelets 87 at both ends that fit over a ball 88 on the ends of the upper and lower sail braces 23 and 26. As seen in FIG. 1*a*, the outer ends of the sail braces 23 and 26 are rectangular in configuration and have outwardly tapered ends 89 adjacent the balls 88 providing a reduced and narrow portion 90 into which the eyelets 87 fit.

A small elastomeric ring 91 is fitted over the bow-like string 86 at each end thereof and it is fitted quite tightly there-around so that the user can cinch the eyelet 87 closely around the narrow portion 90. This prevents the eyelets from falling off the balls 88 when the sail is in its collapsed and untensioned position illustrated in FIG. 12, or in any untensioned position of the sail support arms 23 and 26.

As seen in FIG. 12, the sail assembly is manipulated to its collapsed position by rotating and ratcheting the lower sail brace 26 upwardly, and the upper sail brace 23 downwardly closely adjacent the user's back and the interengaging grooves 61 and ribs 63 hold the brace arms in these collapsed positions.

As seen in FIG. 3, a plastic hook 95 is fixed to the upper portion of the base 14 midway between the masts 21 so the skater can carry articles such as a backpack, water bottle or clothing, freeing the skater's hands and arms for skating and sailing manipulations.

In FIGS. 13 to 18, a second embodiment of my body mounted sail assembly is illustrated designated generally by the reference numeral 110, and is seen to include generally a base 114, identical left and right sail assemblies 116 and 118, and a central mounted backpack hook 119. Since the sail assemblies 116 and 118 are identical, the following detailed description will be limited to sail assembly 118, which includes an upper base mounted bracket 120, and an identical lower base mounted bracket 121, an upper pivot assembly 123, an identical lower pivot assembly 124, an upper extruded sail brace 126, and a lower identical extruded sail brace 128, carrying tensioning sail 130.

The base 114 is similar in construction and flexibility to the base 14 described with respect to the FIGS. 1 to 12 embodiment.

Figure 15:
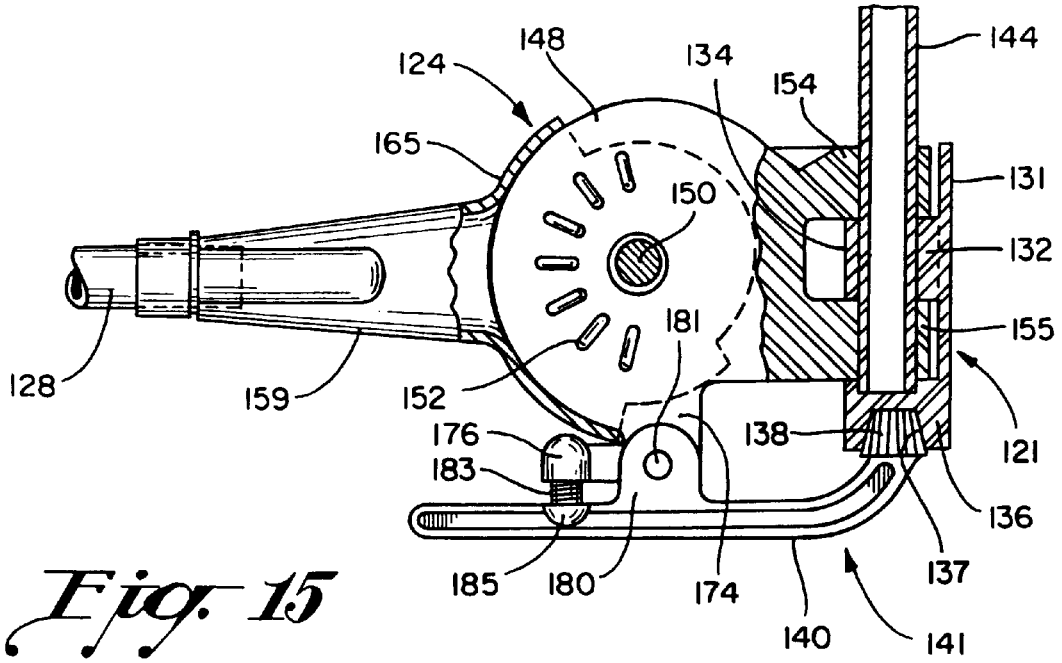
FIG. 15 is a fragmented side view of the lower mast carried pivot assembly.

As noted above, the upper and lower brackets 120 and 121 are identical and include a plate portion 131, as seen in FIG. 15, and a central boss 132, having a semi-annular recess for receiving mast section 144. A removable clamping plate 134 clamshells the mast against the semi-annular boss 132. A lower annular boss 136 is provided integral with the bracket and it has a toothed frusto-conical recess 137 for receiving the external frusto-conical gear teeth 138 integrally formed on one end of sail locking arm 140, which forms part of sail locking mechanism 141.

Figure 14:
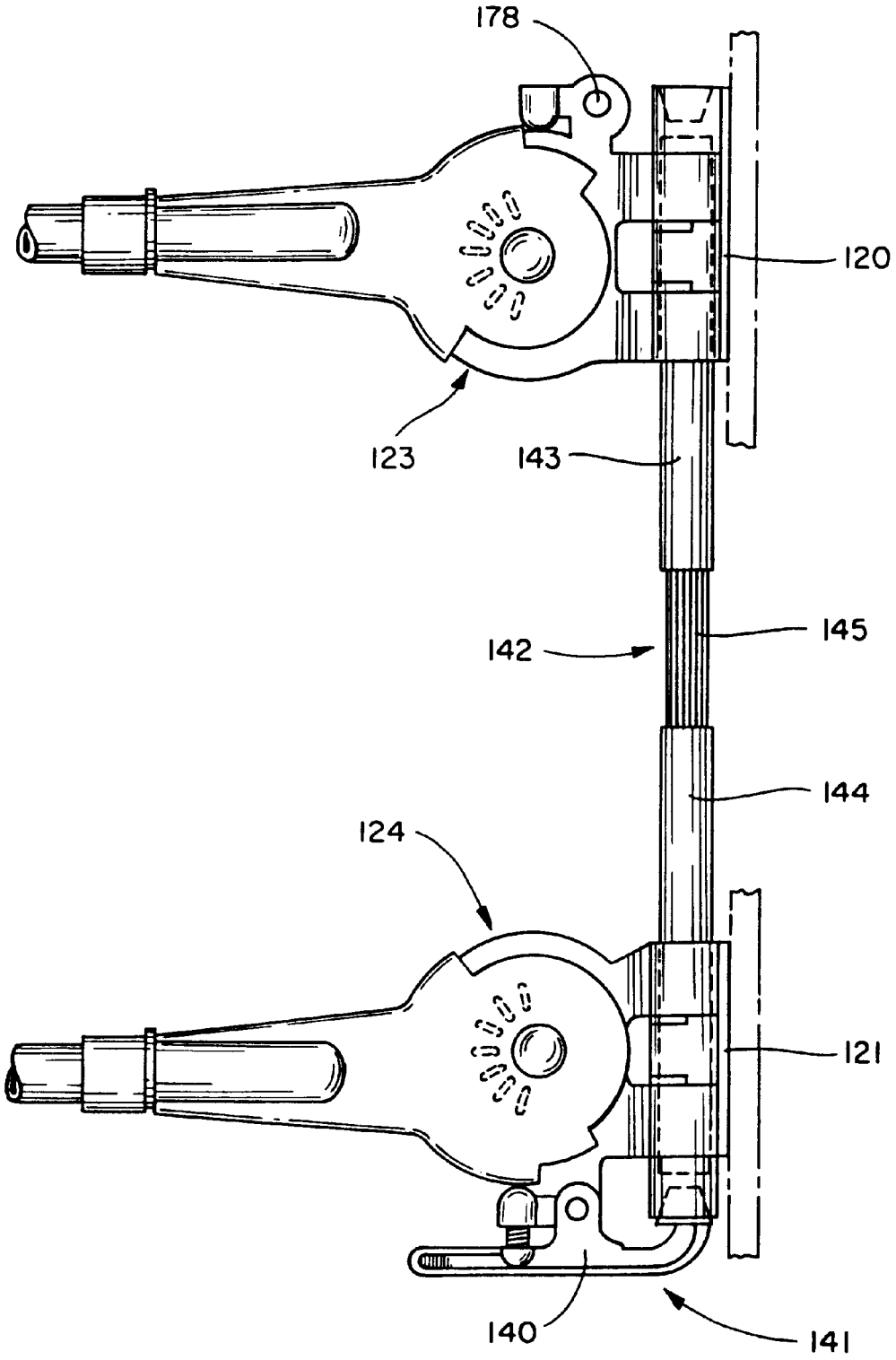
FIG. 14 is a fragmented side view of the body mounted sail assembly shown in FIG. 13.

Mast assembly 142 shown in FIG. 14, includes an upper portion 143 clamshelled in upper bracket 120, a lower section 144 clamshelled in lower bracket 121, and a central splined section 145 telescopically received in the upper section 143 and the lower section 144 to accommodate body flexing and different sized bases 114.

The upper and lower pivot assemblies 123 and 124 are identical except that only the lower pivot assembly carries the sail lock operating arm 140.

Figure 18:
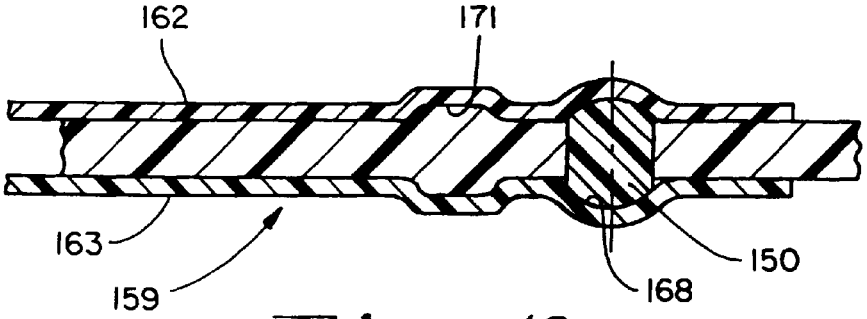
FIG. 18 is a longitudinal section through the pivot axis of one of the pivot assemblies.

As seen in FIG. 15, the pivot assemblies include a circular vertically oriented disc member 148, having a central bore with a spheroidal member 150 positioned therein and shown more clearly in FIG. 18, with a plurality of radial ribs 152 integral therein to provide the necessary ratcheting indexing motion for sail tensioning and collapsing, and a pair of integral spaced annular bosses 154 and 155 that receive and are fixed to a mast section 144.

The pivot assembly 124 (as well as pivot assembly 123) includes a socket member 159 that removably receives the brace or boom 128. Socket member 159 has an outwardly tapered socket portion 160 that has a proximal end 161 with a diameter about three times the diameter of the brace 128 to provide added structural integrity to the pivot assembly 124.

Figure 16:
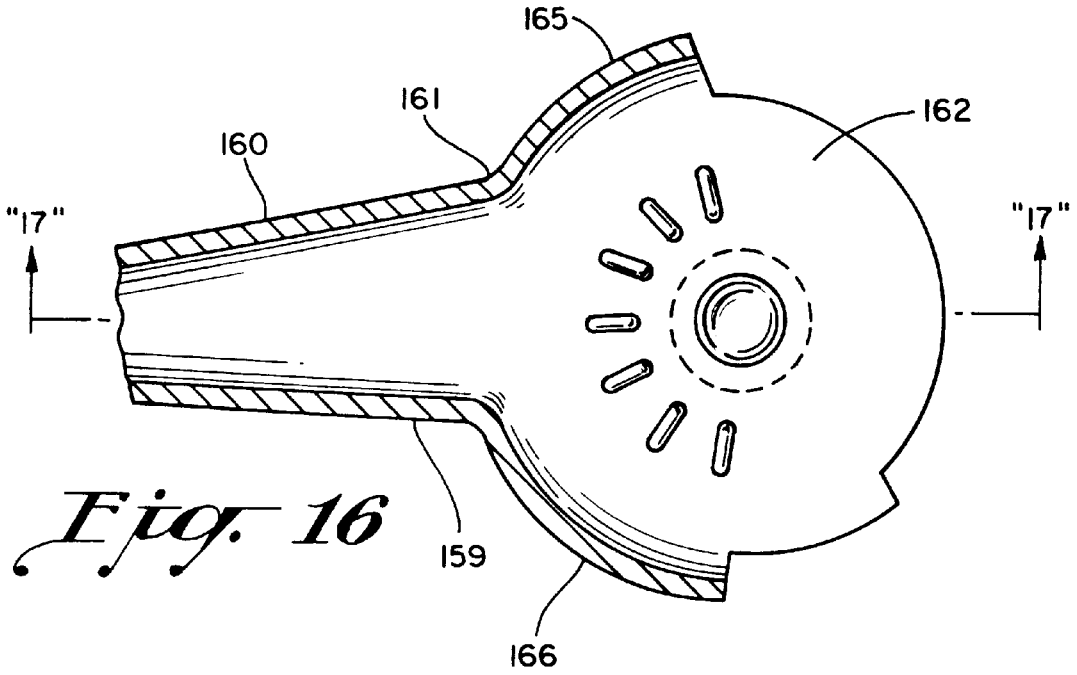
FIG. 16 is an enlarged longitudinal section through the socket member shown in the pivot assembly of FIG. 15.
Figure 17:
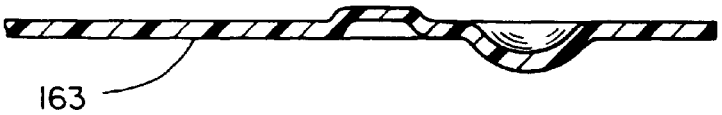
FIG. 17 is a longitudinal section through the socket member taken generally along line 17—17 of FIG. 16.

The socket member 159 has spaced side walls 162 and 163 connected by annular rim wall portions 165 and 166, shown in FIGS. 15 and 16 for added strength. The side walls 162 and 163 have semi-spheroidal recesses 168 that receives spheroidal member 150 for pivotally mounting the socket member 159 on the disc member 148, while at the same time permitting disengagement between these two parts upon sufficient impact force. Each of the plates or walls 162 and 163 have radially positioned recesses or grooves 171 for receiving the ribs 152 on the disc 148 to lock the socket in the desired angular position. As seen in FIG. 16, the side walls 162 and 163 extend 360 degrees about the axis of the spheroidal member 150, and have 360 degrees of face contact with the disc member 148 to provide better structural integrity over the pivot assemblies shown and described above with respect to FIGS. 1 to 12.

The disc 148 has a downwardly projecting flange 174 that has an integral spring seat boss 176 extending outwardly therefrom. The flange 174 has a bore 178 therein (see upper pivot assembly 123 in FIG. 14) for receiving a pin that pivotally mounts arm 140 to the disc 148. The arm 140 has a pair of spaced mounting bosses 180 that receive a pin 181 extending through hole 178. A spring 183, seated in spring seat 176, and another seat 185 in arm 140 rotates the arm 140 to its sail locking position. The sail locking mechanism 141 operates in the same manner as the locking mechanism in the FIGS. 1 to 12 embodiment.

Another distinguishing feature of the FIGS. 13 to 18 embodiment is the removability of the braces 126 and 128 from the pivot assemblies. This enables the manufacturer to have a variety of brace lengths to accommodate different-sized sails, and thus have different models for different users. It also enables the braces to be replaced at a low cost if damaged.

Figure 19:
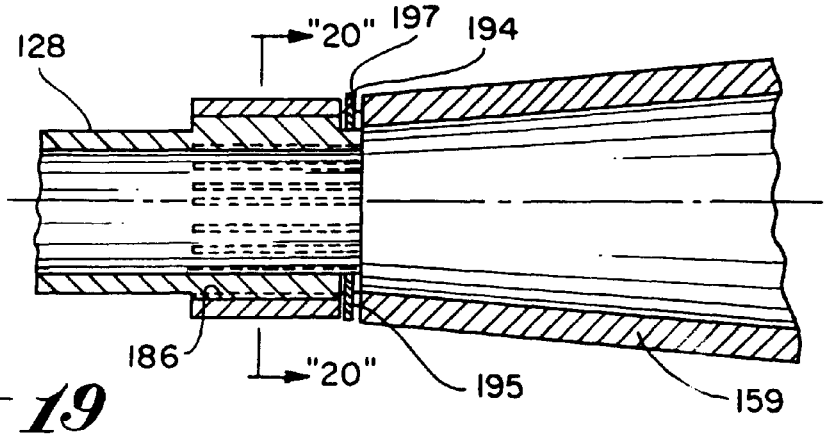
FIG. 19 is a fragmentary longitudinal section illustrating the connection between the proximal end of the braces and the sockets.
Figure 20:
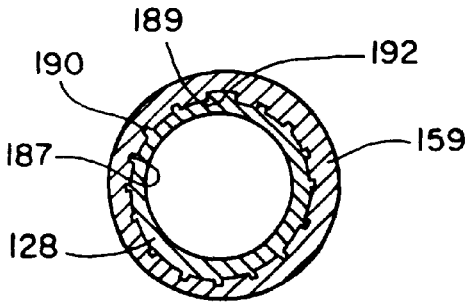
FIG. 20 is a cross-section taken generally along line 20—20 showing the interconnecting elements between the braces and the sockets.

As seen in FIGS. 19 and 20, the socket member 159 has a bore 186 in its distal end, having a plurality of small integral axial grooves 187 therein and integral key slot 189. The ends of the braces 126, 128 have a plurality of flexible axial teeth 190 thereon that lock in the small grooves 187 in the socket bore 186 that provide an extremely tight fit between the braces and the socket member without requiring special tools. The ends of the braces are also provided with an integral key 192 that fits in key slot 189 in the socket member 159 to properly angularly orient the braces in the bores 187.

As seen in FIG. 19, a removable "C" clip 194 fits in a semi-circular slot 195 in socket 159 and a semi-annular groove 197 in the brace 128 to axially lock the brace in the socket bore 186.

The braces 126 and 128 are identical and are generally "S" shaped in configuration to accommodate the sail shape, which is narrower at luff portion 198 than it is at roach 199. The upper brace, of course, is rotated 180 degrees with respect to the lower brace 128, and both are identical plastic extrusions that have a generally annular cross section.

Figure 21:
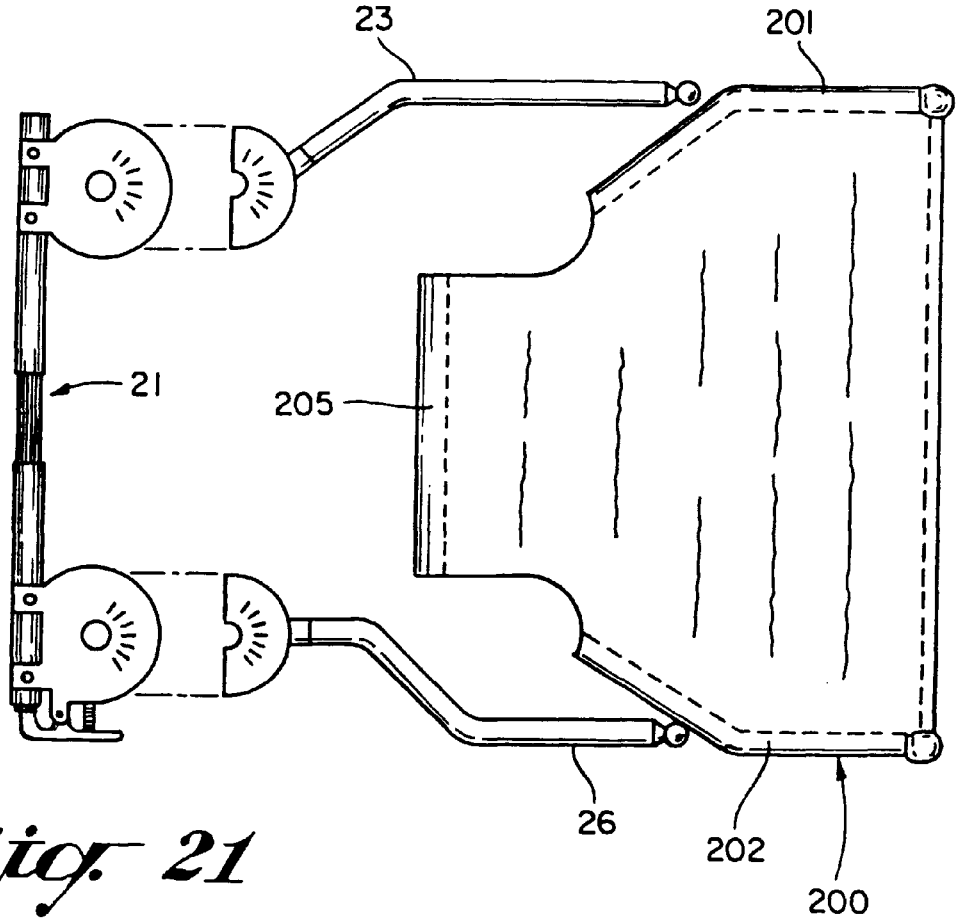
FIG. 21 is an exploded view of a mast assembly and braces similar to the one shown in FIGS. 1 to 12 including a modified sail design.
Figure 22:
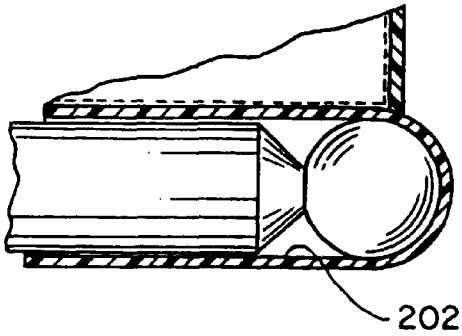
FIG. 22 is an enlarged fragmented section showing pockets in the sail shown in FIG. 21 for the ends of the braces.
Figure 23:
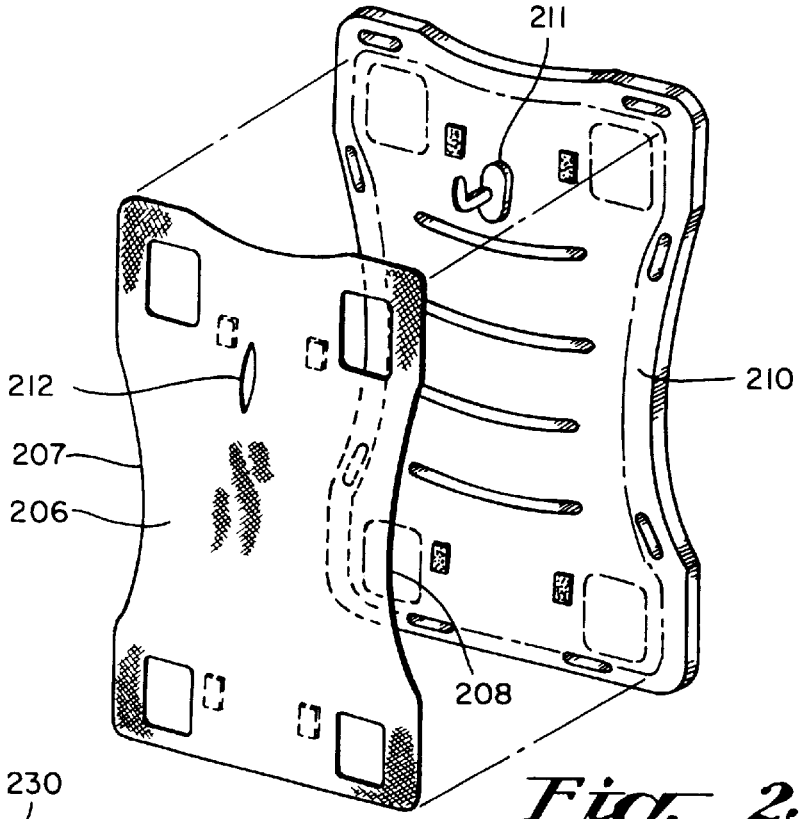
FIG. 23 is an exploded view of a modified base and central sail portion.

FIG. 21 is a side view illustrating the mast assembly 21 and the upper and lower sail braces 23 and 26 similar to the FIGS. 1 to 12 embodiment with a modified sail 200. Sail 200 eliminates the bow string 86 in the FIGS. 1 to 12 embodiment and has slots 201 and 202 therein for receiving the upper and lower braces 23 and 26. This arrangement significantly reduces the cost of the overall assembly, but more importantly is much easier for the user to assemble. Sail 200 has a vertical seam illustrated at 205 to which a central sail portion 206 illustrated in FIG. 23 is attached. Central sail portion 206 is connected along edge 207 to the luff of the port side sail and is connected along edge 208 to the starboard sail at the luff 205 illustrated in FIG. 21. The sail portion 206 eliminates the butterfly appearance of the two sail assemblies from the aft so that from this sight line, the two sails appear as one continuous sail.

The assembly in FIG. 23 includes a modified body attachable base 210 that has a backpack hook 211 mounted centrally near the top of the base 210. Central sail portion 206 may have an aperture 212 therethrough to permit the backpack hook to extend therethrough.

Figure 24:
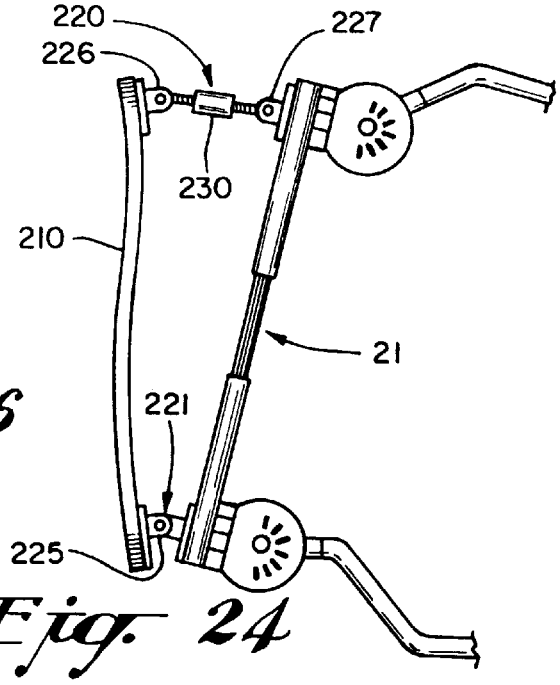
FIG. 24 is a fragmented side view of modified upper and lower mast brackets.

FIG. 24 illustrates a modified upper mast bracket assembly 220 and a modified lower mast bracket assembly 221 for adjusting the angular orientation between base 210 and mast assembly 21. The lower bracket assembly 221 includes a horizontal pivot 225 and the upper bracket assembly 220 includes a first horizontal pivot 226 and a second horizontal pivot 227 interconnected by an axially adjustable rod assembly 230. Adjustable rod assembly 230 and the pivots 225, 226 and 227 enable the mast assembly 21 to be angularly adjustable relative the base 210 by the user so that the mast assembly 21 can remain, if desired, generally vertical while the user's back is bent forward in the skating position. This improves the sail efficiency by maintaining the mast generally vertical.

Figure 25:
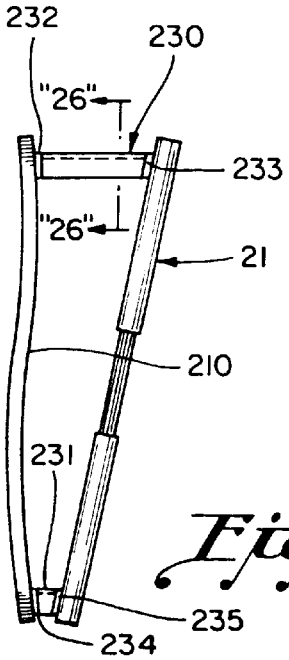
FIG. 25 is a side view of further modified upper and lower mast brackets.
Figure 26:
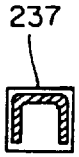
FIG. 26 is an enlarged cross-section of the upper mast bracket shown in FIG. 25 taken generally along line 26—26.

A further modified form of the upper and lower bracket assemblies to achieve the same end is illustrated in FIGS. 25 and 26 in a somewhat simpler fashion. In FIG. 25, an upper bracket assembly 230 spaces the upper end of the mast assembly 21 from the body base 210 and a lower shorter bracket assembly 231 spaces the lower end of the mast assembly 21 from the base 210. Upper and lower bracket assemblies 230 and 231 are similar except for their length and include U-shaped channels 237 velcroed at 232 to the base and 233 to the mast, and lower bracket assembly 231 is velcroed at 234 to the base and at 235 to the mast. This is simply somewhat less costly than the pivot assemblies included in the upper and lower bracket assemblies 220 and 221 in the FIG. 24 embodiment.

What is claimed is:

1. A human body sail assembly for sport and transportation, comprising: a base adapted to be attached to the user with back supported portions, mast bracket means fixed to the back supported portions of the base, at least one mast having an axis carried by the bracket means, a sail support extending radially outward from the mast and rotatable about an axis substantially coaxial with the mast axis, a sail carried by said sail support extending outwardly therewith, means for setting the sail in a variety of angular portions in generally vertical planes, said sail support including a pivot assembly carried by the mast and a brace extending outwardly from the pivot assembly, said pivot assembly including a disc member carried by the mast and brace socket member having spaced walls indexably engaging the sides of the disc member.

2. A human body assembly as defined in claim 1, wherein the brace socket member is rotatable on the disc member about a generally horizontal axis so the brace can swing in a vertical plane, said disc member having a central spheroidal portion for pivotally mounting the socket member thereon.

3. A human body assembly as defined in claim 2, wherein the socket member has integral spheroidal recesses in the spaced walls for receiving the spheroidal portion of the disc member.

4. A human body sail assembly for sport and transportation, comprising: a base adapted to be attached to the user with back supported portions, upper and lower mast brackets fixed to the back support portions of the base, at least one mast having an axis carried by the bracket means, upper and lower sail supports extending radially outward from the mast and rotatable about an axis substantially coaxial with the mast axis, a sail carried by said sail supports extending outwardly therewith, and means between at least one of said sail supports and the base for indexing and releasably locking the sail support and sail about the mast axis in a plurality of fixed positions with respect to the base, and for setting the sail in a variety of angular positions in generally vertical planes including a first toothed member generally coaxial with the mast and fixed with respect to one of the mast brackets, and shiftable second toothed member generally coaxial with the mast and carried by the sail support and selectively engageable with the first toothed member to selectively lock the sail in a desired angular position, both of said upper and lower mast brackets being identical.

5. A human body sail assembly as defined in claim 4, wherein said first toothed member is a first frusto-conical gear and said second toothed member is a complementary second frusto-conical gear, a manual operator for said second frusto-conical gear, and means biasing said second frusto-conical gear toward said first frusto-conical gear.

6. A human body sail assembly for sport and transportation, comprising: a base adapted to be attached to the user with back supported portions, mast bracket means fixed to the back supported portions of the base, at least one mast having an axis carried by the bracket means, a sail support extending radially outward from the mast and rotatable about an axis substantially coaxial with the mast axis, a sail carried by said sail support extending outwardly therewith, means for setting the sail in a variety of angular portions in generally vertical planes, said sail support including a socket assembly carried by the mast and a brace fixed in the socket assembly, said brace being releasably mounted in the socket assembly to permit replacement or to accommodate different length braces.

7. A human body sail assembly as defined in claim 6, including means removably mounting the brace in the socket assembly including key means integral with the socket assembly and brace for angularly orienting the brace in the socket assembly.

8. A human body sail assembly as defined in claim 6, including means removably mounting the brace in the socket assembly including a plurality of axial ribs on the end of the brace and a plurality of axial grooves in a brace receiving bore in the socket assembly.

9. A human body sail assembly as defined in claim 6, including a removable "C" clip for axially holding the brace in the socket assembly.

10. A human body sail assembly for sport and transportation, comprising: a base adapted to be attached to the user with back supported portions, upper and lower mast brackets fixed to the back supported portions of the base, at least one mast having an axis carried by the bracket means, upper and lower sail supports extending radially outward from the mast and rotatable about an axis substantially coaxial with the mast axis, a sail carried by said sail supports extending outwardly therewith, means for setting the sail in a variety of angular positions in generally vertical planes, said sail supports including upper and lower pivot assemblies each with a brace extending outwardly therefrom, said braces being identical except for orientation and being generally "S" shaped.

11. A human body sail assembly as defined in claim 10, wherein the braces are extruded plastic.

12. A human body sail assembly as defined in claim 10, including means removably mounting the brace in the socket assembly including key means integral with the socket assembly and brace for angularly orienting the brace in the socket assembly.

13. A human body sail assembly as defined in claim 10, including means removably mounting the brace in the socket assembly including a plurality of axial ribs on the end of the brace and a plurality of axial grooves in a brace receiving bore in the socket assembly.

14. A human body sail assembly as defined in claim 10, including a removable "C" clip for axially holding the brace in the socket assembly.

15. A human body sail assembly for sport and transportation, comprising: a base adapted to be attached to the user with back supported positions, upper and lower mast brackets fixed to the back supported portions of the base, two masts having an axis carried by the bracket means, upper and lower sail supports extending radially outward from each of the masts, a sail carried by each set of said sail supports extending outwardly therewith, means for setting the sails in a variety of angular positions in generally vertical planes, and a third sail member extending between and attached to the sails at the luff thereof.

16. A human body sail assembly as defined in claim 15, wherein the braces are extruded plastic.

17. A human body sail assembly as defined in claim 15, wherein each of the sail supports includes a brace mounted in a socket, and means removably mounting the brace in the socket assembly including key means integral with the socket assembly and brace for angularly orienting the brace in the socket assembly.

18. A human body said assembly for sport and transportation, comprising: a base adapted to be attached to the user with back supported positions, upper and lower mast brackets fixed to the back supported portions of the base, at least one mast having an axis carried by the bracket means, upper and lower sail supports extending radially outward from the mast, a sail carried by said sail supports extending outwardly therewith, and means for setting the sail in a variety of angular positions in generally vertical planes, each of said sails having closed ended pockets for receiving the upper and lower sail supports.

19. A human body sail assembly for sport and transportation, comprising: a base adapted to be attached to the user with back supported portions, upper and lower mast brackets fixed to the back supported portions of the base, at least one mast having an axis carried by the bracket means, upper and lower sail supports extending radially outward from the mast, a sail carried by said sail supports extending outwardly therewith, and means for setting the sail in a variety of angular positions in generally vertical planes, said upper bracket including means for spacing the upper portion of the mast further from the base than the lower bracket so the mast is angularly related to the base.

20. A human body sail assembly as defined in claim 19, wherein the braces are extruded plastic.

21. A human body sail assembly as defined in claim 19, wherein the means for spacing the upper portion of the mast from the base is adjustable.

* * * * *